United States Patent [19]

Thomas

[11] 4,073,453

[45] Feb. 14, 1978

[54] RAILROAD WARNING SIGNAL DEVICE

[76] Inventor: Marion V. Thomas, 545 Thornwood Drive, Baton Rouge, La. 70806

[21] Appl. No.: 796,471

[22] Filed: May 12, 1977

[51] Int. Cl.[2] ..... B61L 29/24

[52] U.S. Cl. ..... 246/125; 40/474; 246/293; 248/218.4; 248/291; 340/47; 350/99

[58] Field of Search ..... 246/111, 125, 260, 292, 246/293, 294, 473 R, 473 A, 477, 479, 483, 484, 485; 240/22, 23, 24, 49, 151; 340/47, 49, 121, 127-133; 248/291, 218.4, 219.4; 40/34, 70 R; 350/99

[56] References Cited

U.S. PATENT DOCUMENTS

| | | | |
|---|---|---|---|
| 285,173 | 9/1883 | Stemen | 240/49 |
| 3,205,478 | 9/1965 | Scheg | 246/125 |
| 3,368,215 | 2/1968 | Clement | 240/49 |

*Primary Examiner*—Trygve M. Blix
*Assistant Examiner*—Reinhard J. Eisenzopf
*Attorney, Agent, or Firm*—Clarence A. O'Brien; Harvey B. Jacobson

[57] ABSTRACT

A warning device visually enhances the signalling of a dangerous situation such as an approaching train at a railroad crossing. The warning device includes oppositely rotating rims to which light reflecting discs are attached in surrounding relation to hubs fixed to the arms of a frame extending laterally from a vertical support post. Fixed light emitting surfaces are mounted on the hub facing opposite directions.

11 Claims, 11 Drawing Figures

10
12
14
16
20
22
24
36
56
58
108
RAILROAD CROSSING
RR 10
12
14
16
22
24
42
56
58
4
5
104
106
108
RAILROAD CROSSING
RR 12
16
18
20
22
28
70
72
74
76
78
80
82
84
86
88
90
92
94
98
112
114
116
120
122
124
126
128
9

RAILROAD WARNING SIGNAL DEVICE

BACKGROUND OF THE INVENTION

This invention relates to a visual warning device particularly adapted for railroad crossings.

Warning signs and signalling devices for railroad crossings are well known. Generally, such signs or signalling devices rely on flashing lamps and illuminated signs to alert motorists of approaching trains or railroad vehicles. The effectiveness of such alerting devices from a visual standpoint is often tragically reduced by malfunction of the illumination source or the accumulation of light blocking dust and by poor visibility because of atmospheric conditions. It is, therefore, an important object of the present invention to provide a signal warning device that will improve the visibility and alerting effectiveness of prior comparable signal warning devices.

SUMMARY OF THE INVENTION

In accordance with the present invention a signal warning device includes a pair of alerting assemblies laterally spaced from a support post by a mounting frame having support arms to which a pair of supporting hubs are connected for rotational mounting of the alerting assemblies. Each hub presents axially spaced, light emitting surfaces that are fixed and face in opposite directions. The surfaces facing one direction are exposed through large openings in the frame arms to which the hubs are connected. The rotating alerting assemblies include light reflective discs mounted on rims rotatably supported on the hubs in surrounding relation to the fixed light emitting surfaces. A motor mounted by the frame between the arms is drivingly connected by gearing to the rims for rotation of the alerting assemblies in opposite directions.

The rotational movement of the alerting assemblies without visual blocking of the fixed hub mounted surfaces, provides good visibility on both sides of the warning device as well as an effective attention generating arrangement.

These together with other objects and advantages which will become subsequently apparent reside in the details of construction and operation as more fully hereinafter described and claimed, reference being had to the accompanying drawings forming a part hereof, wherein line numerals refer to like parts throughout.

BRIEF DESCRIPTION OF THE DRAWING FIGURES

DETAILED DESCRIPTION OF THE PREFERRED EMBODIMENTS

Figure 2:
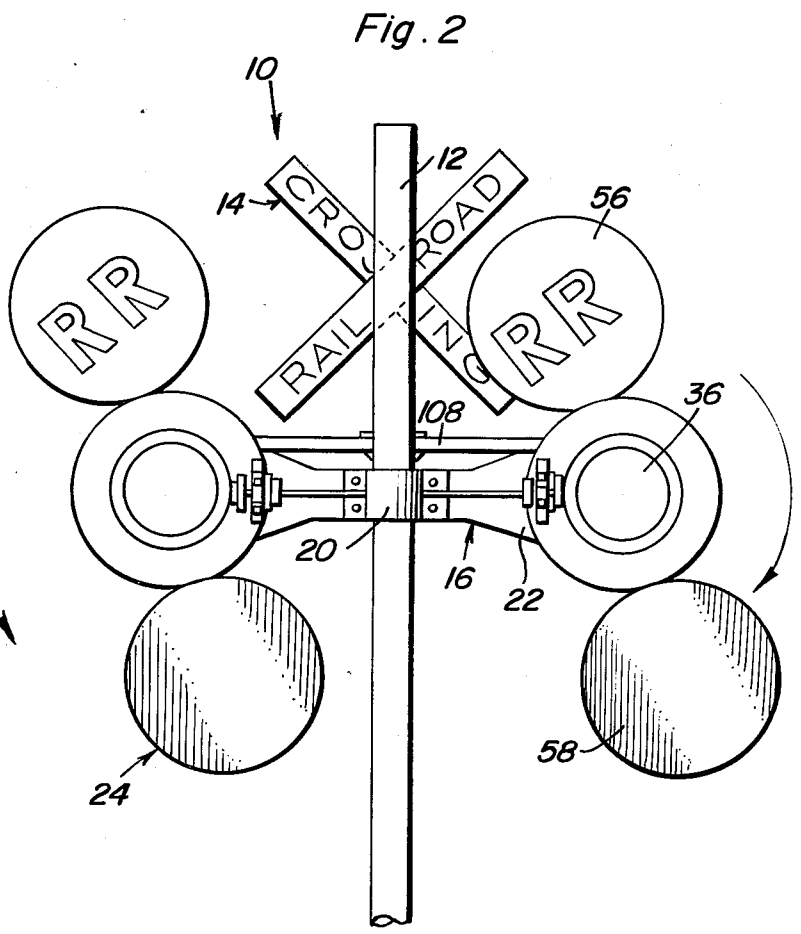
FIG. 2 is a rear elevational view of the device shown in FIG. 1.
Figure 1:
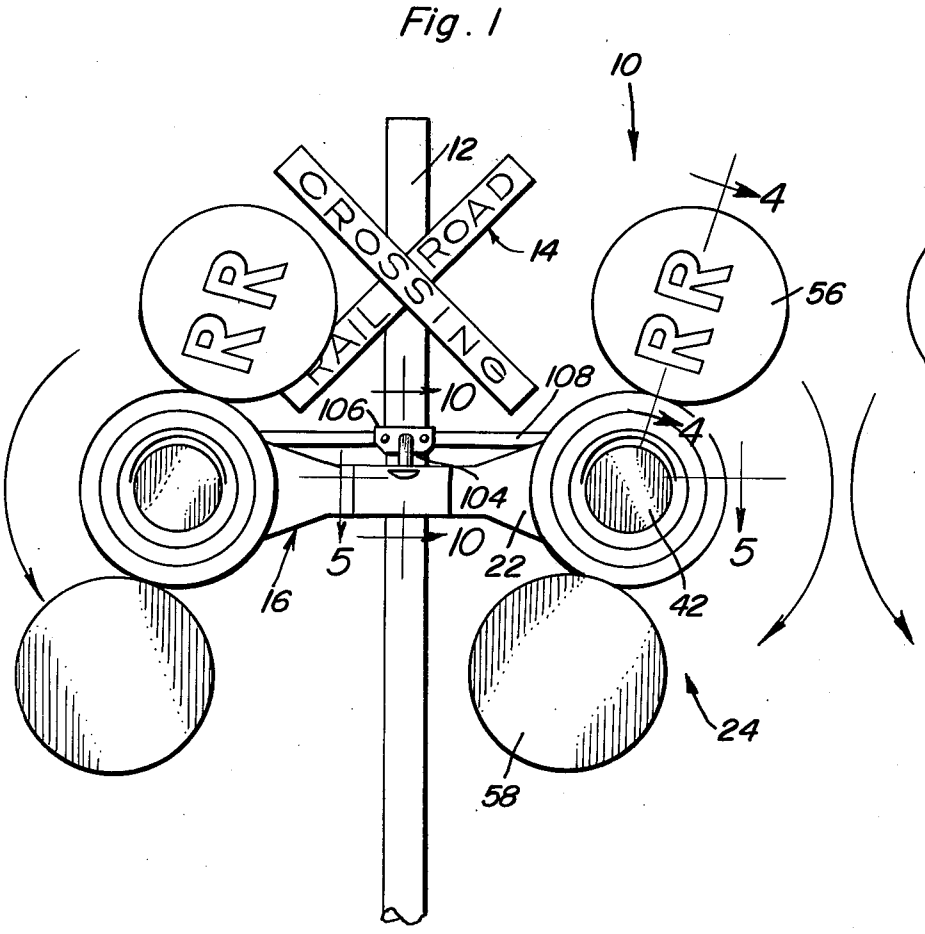
FIG. 1 is a front elevational view of a warning signal device constructed in accordance with the present invention.
Figure 3:
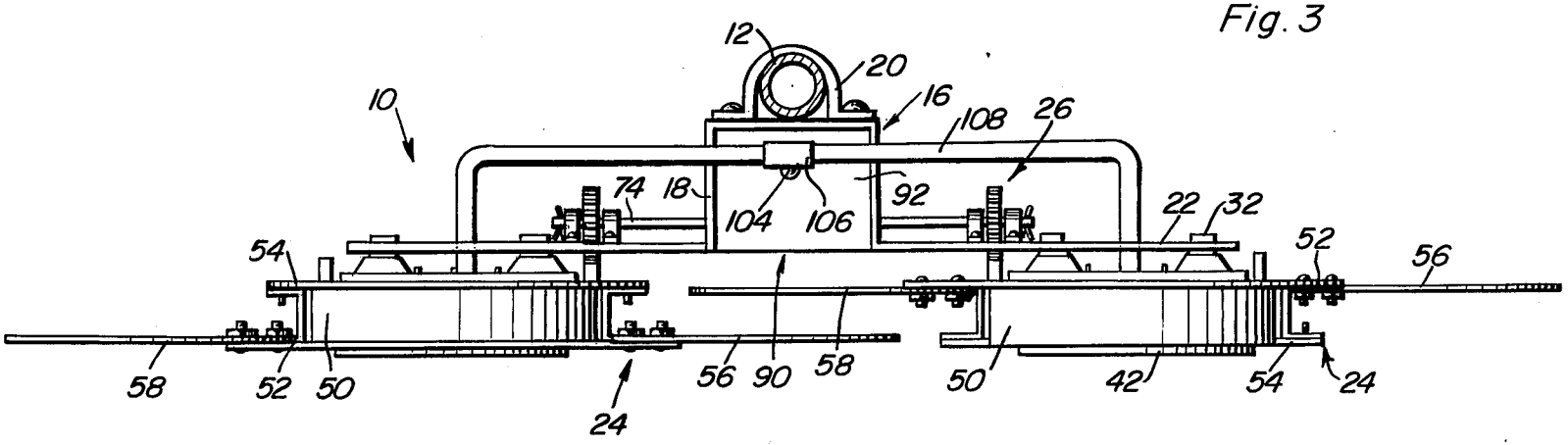
FIG. 3 is a top plan view of the device shown in FIGS. 1 and 2.

Referring now to the drawings in detail, FIGS. 1, 2 and 3 illustrate a railroad crossing type of warning signal device generally referred to by reference numeral 10. The warning signal device may be mounted on a conventional railroad warning sign post 12 below the usual railroad warning signs 14. The warning signal device of the present invention may, of course, be mounted on any other vertical post or support structure.

The warning signal device 10 includes a frame assembly generally referred to by reference numeral 16 mounted on the post 12. The frame includes a bracket portion 18 secured to the post by means of a clamp 20. A pair of planar arm portions 22 of the frame extend laterally from the bracket portion transversely of the post and spaced forwardly therefrom. Each arm portion 22 rotatably mounts a movable or rotatable alerting signal assembly generally referred to by reference numeral 24. Both of the alerting signal assemblies 24 are adapted to be rotated in opposite rotational directions, as indicated by arrows in FIGS. 1 and 2, by means of a power drive assembly generally referred to by reference numeral 26 in FIG. 3.

Figure 5:
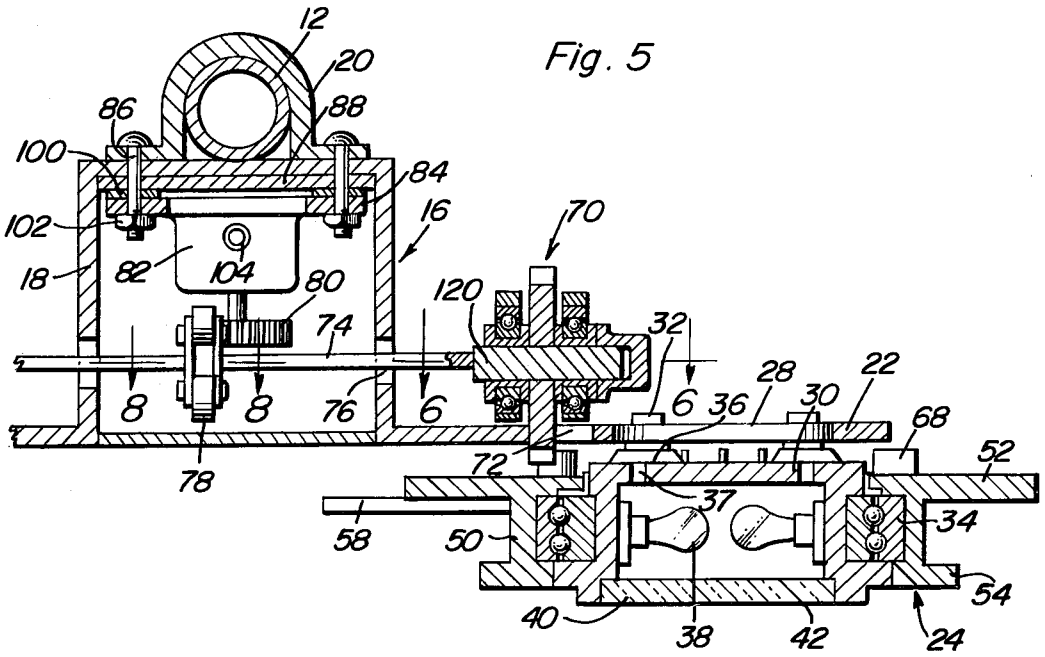
FIG. 5 is an enlarged partial section view taken substantially through a plane indicated by section line 5—5 in FIG. 1.
Figure 11:
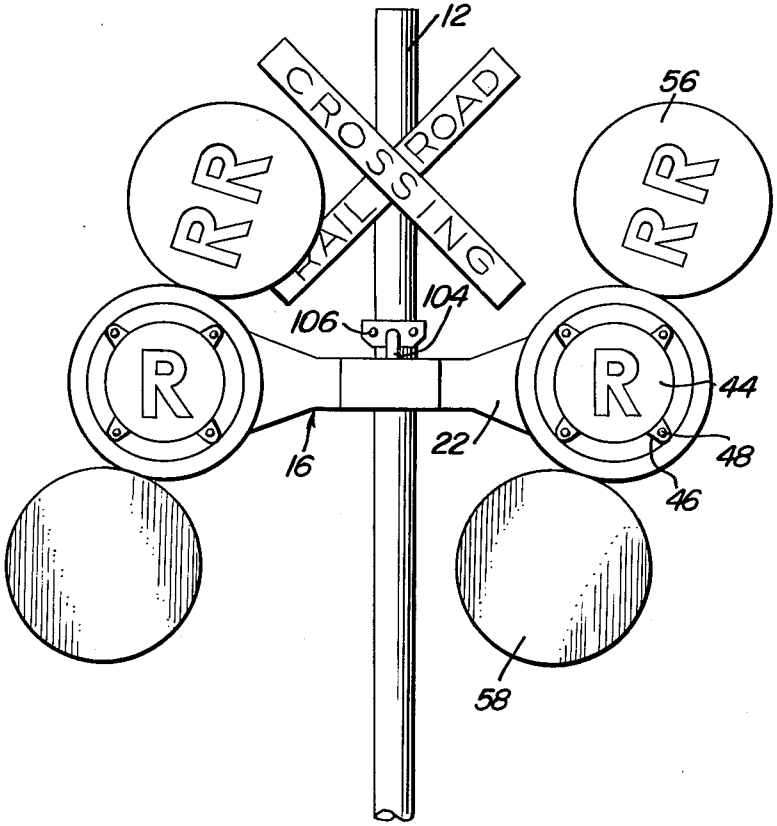
FIG. 11 is a front elevation view similar to FIG. 1 but showing a modification.

As more clearly seen in FIG. 5, each of the planar arm portions 22 of the frame is provided with a large circular opening 28 coaxially aligned with a hub 30 fixed to the arm portion in close parallel spaced relationship thereto by means of a plurality of fastener assemblies 32. The fastener assemblies extend through the arm portion 22 of the frame in peripheral relationship to the circular opening 28. By means of a bearing assembly 34 mounted thereon, the hub 30 establishes a rotational axis that extends centrally through the opening 28 about which the movable alerting signal assembly 24 is rotatable. The hub 30 also presents a reflective type of light emitting surface 36 which faces one direction and is exposed through the opening 28. In the embodiment illustrated in FIG. 5, the hub 30 encloses a chamber within which a source of illumination 38 is located so as to emit light through a light transmissive cover 40 fixed to the hub and having a light emitting surface 42 facing in an axial direction opposite to that of surface 36. Port holes 37 extend through the face 36 of the hub so that one may inspect the interior thereof to see if the lamps 38 are operative. Accordingly, the hub 30 supports surfaces that are visible on both sides of the warning signal device 10 of the present invention. It will, of course, be appreciated that electrical energy for operating the light bulbs 38, constituting the source of illumination, must be available according to the embodiment illustrated in FIG. 5. Alternatively, a light reflective surface cover 44 may be placed over the cover 40 as shown in in FIG. 11. The cover 44 is accordingly provided with radial projecting tabs 46 by means of which it is secured to the hub by means of fasteners 48.

Figure 4:
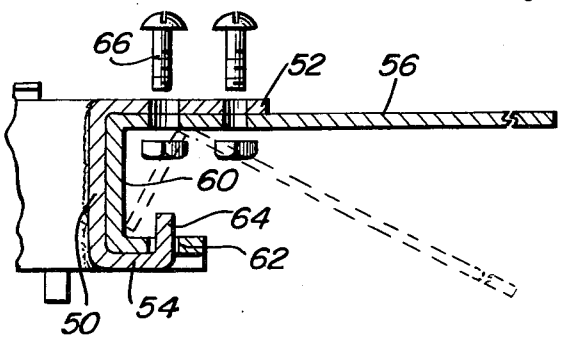
FIG. 4 is an enlarged partial section view taken substantially through a plane indicated by section line 4—4 in FIG. 1.

As more clearly seen in FIG. 5, the movable alerting assembly 24 has associated therewith a mounting rim 50 supported by the bearing assembly 34. The mounting rim includes a pair of axially spaced, radial flanges 52 and 54. The radial flange 52 closer to one of the planar arm portions 22 of the frame is radially longer than the other radial flange 54. Secured to the rim by means of the radial flanges are a pair of planar discs 56 and 58 as more clearly seen in FIGS. 1 and 2. One of the discs 56 may bear indicia while the other of the discs may be brightly colored red on both reflective sides thereof. The discs are positioned on the rim in 180 degrees relationship to each other for rotation therewith about the rotational axis established by the hub 30 and in surrounding relationship to the fixed light emitting surfaces 36 and 42. As more clearly seen in FIG. 4, each disc 56 or 58 is detachably secured to the rim 50. Toward that end, each disc is provided with a folded connecting tab 60 that is fitted into the rim at a predetermined location between the radial flanges 52 and 54. An opening 62 is formed in the portion of the tab 60 abutting the flange 54 so as to receive a projection 64. Fastener assemblies 66 interconnect the flange 52 with the disc tab 60 through aligned openings formed in the flange 52 and the tab 60. With reference to FIG. 3, it will be observed that the rim 50 associated with the right hand movable alerting device differs from the left hand rim 50 with respect to the relative axial positions of the long and short radial flanges 52 and 54. Since the discs 56 and 58 extend from the longer of the radial flanges 52, both rims 50 will carry their discs in parallel but axially spaced relationship to each other so as to avoid interference with each other as both movable alerting devices are simultaneously rotated.

As more clearly seen in FIG. 5, the power drive assembly 26 includes a plurality of circumferentially spaced blades 68 projecting axially from the rim 50 for engagement by a gear 70 projecting through a slot 72 formed in the planar arm portion 22 of the frame adjacent to the circular opening 28 on that side thereof closest to the bracket portion 18. The gear 70 is fixed to one end portion of a drive shaft 74 that extends through a slotted opening 76 formed in the bracket portion 18 of the frame. Accordingly, a pair of such drive shafts are operable to impart rotation to a pair of gears 70 in order to transmit rotation to rims 50 in opposite rotational directions. The ends of the drive shafts 74 within the bracket portion 18 of the frame are connected to a drive gear 78 which is in meshing engagement with a power gear 80 driven by an electric motor 82 fixedly mounted within the bracket portion 18 of the frame.

Figure 10:
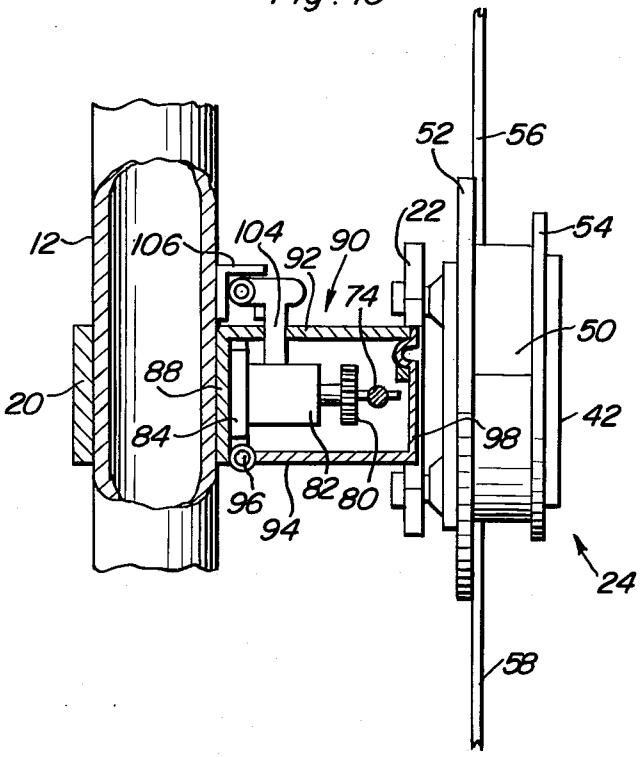
FIG. 10 is an enlarged partial section view taken substantially through a plane indicated by section line 10—10 in FIG. 1.

As more clearly seen in FIGS. 5 and 10, the drive motor 82 has a mounting flange 84 secured in place within the bracket portion 18 by a plurality of fastener screws 86 that extend through aligned openings in the clamp 20, the bracket portion 18 and the mounting flange 84. The fastener screws 86 also extend through the back wall 88 of a motor enclosure 90 having a top wall 92, a bottom wall 94 hingedly connected to the back wall by a hinge 96 and a front wall 98 adapted to be latched in closed position to the top wall as shown by solid line in FIG. 10. The bottom wall 94 and front wall 98 connected thereto may be opened as shown by dotted line in FIG. 7 for disassembly of the motor. Nut elements 100 on the fastener screws 86 secure the back wall 88 to the bracket as well as to space the mounting flange 84 of the motor therefrom. Nuts 102 secured to the fastener screws 86 on the other side of the mounting flange 84 hold the motor assembled in place. A tubular fitting 104 projects upwardly from the motor housing through an opening in the top wall 92 of the motor enclosure 90 and is connected through a bracket 106 to conductor enclosing conduits 108 extending in opposite directions to each of the hubs 30 so as to carry electrical energy to the light bulbs 38 as aforementioned.

Figures 6, 7, 8, 9:
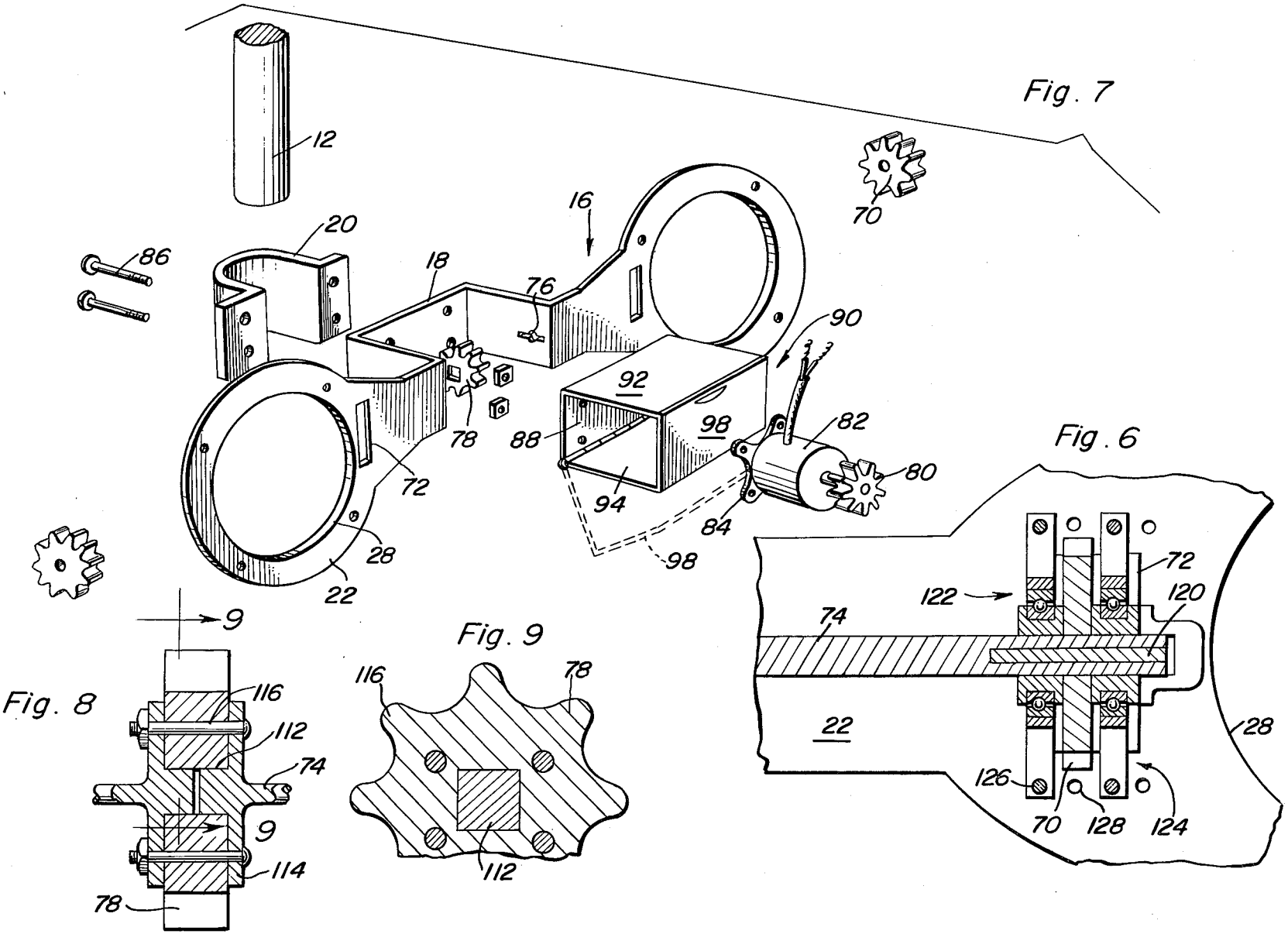
FIG. 6 is an enlarged partial section view taken substantially through a plane indicated by section line 6—6 in FIG. 5.
FIG. 7 is a perspective view of certain disassembled parts of the warning device.
FIG. 8 is an enlarged partial sectional view taken substantially through a plane indicated by section line 8—8 in FIG. 5.
FIG. 9 is a partial sectional view taken substantially through a plane indicated by section line 9—9 in FIG. 8.

As is more clearly seen in FIGS. 8 and 9, each of the drive shafts 74 is connected to the drive gear 78 by means of a non-circular axial formation 112 received within a corresponding central opening formed in the body of the drive gear 78. The formation 112 extends axially from a retainer plate portion 114. Thus, plate portions 114 on opposite axial sides of the gear 78 are held assembled by means of fastener bolt assemblies 116.

The gears 70 connected to the outer ends of the drive shafts 74 are secured to the drive shafts by means of spline blades 120 as more clearly seen in FIGS. 5 and 6. Each gear 70 is axially positioned for driving engagement with the blades 68 on the rim 50 by means of a pair of journal bearing assemblies 122 and 124 that are secured to the planar arm portion of the frame by fasteners 126. A plurality of fastener openings 128 are formed in the planar arm portion so that the locations of the journal bearing assemblies 122 and 124 may be changed in order to alternately position the gear 70 adjacent opposite sides of the slot 72 in order to compensate for wear of the gear and thereby extend the operating life of the power drive assembly.

Operation of the motor 82 and the light bulbs 38 if utilized is initiated manually or automatically by remote control in a manner well known in the art. The motor is connected to a suitable source of electrical energy through the fitting 104 by electrical cable anchored to the bracket 106. To further enhance the utility of the warning device, the rims 50 of each rotatable assembly 24 may be painted half white and half red with a suitable reflective paint to produce a red and white stripe image at a distance when the assemblies are rotating. When such stripe images are not discernable, the observer will know that the warning device is not operating.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A visual warning device adapted to be mounted on a vertically elongated post, comprising a frame extending transversely of the post, and having an opening formed therein in laterally spaced relation to the post, a hub having light emitting surfaces facing opposite directions, means fixedly mounting the hub on the frame for exposure of one of said light emitting surfaces through said opening in the frame, a mounting rim rotatably mounted on said hub, movable alerting means connected to said mounting rim for rotation about said light emitting surfaces of the hub, and powered drive means mounted on the frame and connected to the rim for imparting said rotation to the movable alerting means.

2. The combination of claim 1 wherein said frame includes a bracket portion secured to the post and a substantially planar arm portion within which said opening is formed.

3. The combination of claim 2 wherein said hub is mounted in close spaced relation to the planar arm portion of the frame and in alignment with said opening to establish a rotational axis substantially perpendicular to the planar arm portion about which the mounting rim is rotatable, said mounting rim projecting radially beyond the planar arm portion of the frame.

4. The combination of claim 3 wherein said alerting means includes at least one planar disc having reflective surfaces substantially parallel to the light emitting surfaces of the hub.

5. The combination of claim 4 wherein said drive means includes a drive motor mounted on the bracket portion of the frame, and gear means drivingly connecting the drive motor to the mounting rim.

6. The combination of claim 1 wherein said alerting means includes at least one planar disc having reflective surfaces substantially parallel to the light emitting surfaces of the hub.

7. The combination of claim 6 wherein said frame includes a bracket portion secured to the post and a substantially planar arm portion within which said opening is formed.

8. The combination of claim 1 wherein said drive means includes a drive motor mounted on the bracket portion of the frame, and gear means drivingly connecting the drive motor to the mounting rim.

9. The combination of claim 1 wherein at least one of the light emitting surfaces is light reflective.

10. A visual warning device adapted to be mounted on a vertically elongated post, comprising a frame extending transversely of the post and having an opening formed therein in laterally spaced relation to the post, a hub having a light emitting surface, means connected to the frame in peripheral relation to said opening for fixedly mounting the hub to establish a rotational axis extending through the opening and intersecting said light emitting surface, and movable alerting means mounted on the hub for rotation about said rotational axis in surrounding relation to the light emitting surface.

11. The combination of claim 10 wherein said movable alerting means includes at least one planar disc having a light reflective surface and rim means rotatably mounted on the hub to which the planar disc is secured in radially spaced relation to the opening in the frame through which one of the light emitting surfaces is exposed.

* * * * *